United States Patent [19]

Dozorsky

[11] Patent Number: 4,982,965

[45] Date of Patent: Jan. 8, 1991

[54] STRATEGIC MILITARY TYPE BOARD GAME

[76] Inventor: Wolodymyr Y. Dozorsky, 3355 Via Lido #365, Newport Beach, Calif. 92663

[21] Appl. No.: 459,988

[22] Filed: Jan. 2, 1990

[51] Int. Cl.[5] ..... A63F 3/02

[52] U.S. Cl. ..... 273/262; 273/242

[58] Field of Search ..... 273/262, 258, 260, 261, 273/242

[56] References Cited

U.S. PATENT DOCUMENTS

| | | | |
|---|---|---|---|
| 1,023,375 | 4/1912 | Hammond | 273/262 |
| 1,210,854 | 1/1917 | Schroer | 273/262 |
| 1,231,683 | 7/1917 | Wood | 273/262 |
| 1,282,964 | 10/1918 | Simcox | 273/262 |
| 1,798,701 | 3/1931 | Reed | 273/262 |
| 2,464,819 | 3/1949 | Lieberman | 273/262 |
| 4,688,802 | 8/1987 | Sandifer | 273/261 |

FOREIGN PATENT DOCUMENTS

| | | | |
|---|---|---|---|
| 27045 | 12/1905 | United Kingdom | 273/261 |
| 403530 | 12/1933 | United Kingdom | 273/262 |

*Primary Examiner*—Benjamin Layno

[57] ABSTRACT

The invention is a game between opposing players having sets of 30 pieces, each set consisting of one capital, two generals, eleven ambients, nine regulars and seven patrols. Each set arranged in identical starting formation on a rectangular game board of 126 checkered square. Each of the sets has one capital which occupies the central square of the end row of 9 squares, and which can be captured by any opposing-set piece that approaches within unobstructed capturing range, and which once captured cannot be retaken, and which cannot itself move or capture any piece but must be protected by the pieces of its own set. All of the other pieces can optionally move, capture opposing-set pieces, or be captured. Each such piece has its allowable range of movement and range of ability to capture other pieces, depending on its type. A piece moves by travelling from one square to another. A capturing piece always displaces the captured piece from its square, and the captured piece is excluded from the field of play. The objective in winning the game is to be the first to capture the capital of the opposing set, while successfully preventing the capture of the capital of one's own set. The players use single alternate moves to proceed with the game. The maximum range of capture is always less than the maximum range of movement for each moveable piece.

2 Claims, 2 Drawing Sheets

The arrangement of both sets on the battlefield before a game begins.

A ambient
C capitol
G general
P patrol
R regular

Figure 1.

The arrangement of both sets on the battlefield before a game begins.

| | | | | | | | | |
|---|---|---|---|---|---|---|---|---|
| | | | G | C | G | | | |
| A | A | A | A | A | A | A | A | A |
| A | P | P | P | P | P | P | P | A |
| R | R | R | R | R | R | R | R | R |
| | | | | | | | | |
| | | | | | | | | |
| | | | | | | | | |
| | | | | | | | | |
| | | | | | | | | |
| | | | | | | | | |
| R | R | R | R | R | R | R | R | R |
| A | P | P | P | P | P | P | P | A |
| A | A | A | A | A | A | A | A | A |
| | | | G | C | G | | | |

A ambient
C capitol
G general
P patrol
R regular

Figure 2.
The moves of the mobile pieces.
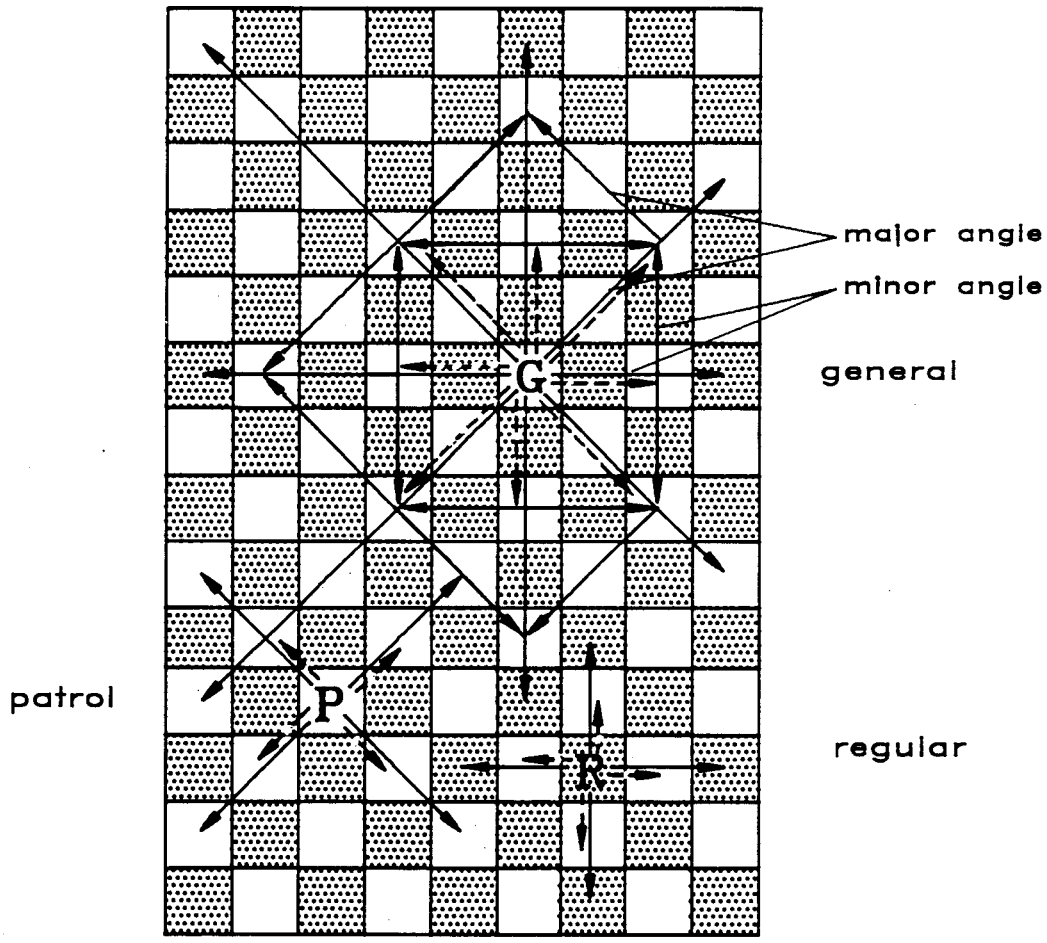
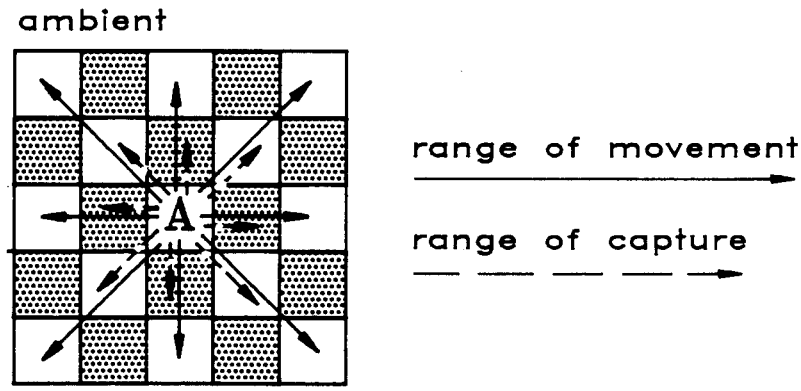
Figure 3.

STRATEGIC MILITARY TYPE BOARD GAME

SUMMARY OF INVENTION HEREIN.

The invention is a game of skill involving two opposing sets of 30 pieces at the onset of the game, each set consisting at the onset of one capital, two generals, nine regulars, seven patrols and eleven ambients, the game being played by single alternate moves on a rectangle of 126 checkered squares, 14 in length and 9 in width. Each piece is a unit always occupying one and no more than one total square, and can be designated belonging either to the black set or the white set. The objective in winning the game is to capture the capital of the opposing set, that is, to occupy the capital square from the distance of capture i the course of the sequence of alternate moves.

Each of the sets has one capital which occupies the central square of the end row of 9 squares, and which can be captured by any opposing-set piece that approaches within unobstructed capturing range, and which once captured cannot be retaken, and which cannot itself move or capture any piece but must be protected by pieces of its own set.

Each of the sets also has two generals, eleven ambients, nine regulars and seven patrols. Within the borders of the 126 checkered squares, all of these pieces can move, capture opposing-set pieces, or be captured, always at the option of the players. EAch piece has its allowable range of movement and range of capture (i.e.: ability to capture) depending on its type. A piece moves by travelling from one square to another. A capturing piece always displaces the captured piece from its square, and the captured piece is excluded from the field of play, which field is the 126 checkered squares at 14 in length and 9 in width, and which field of play can also be called the battlefield.

BRIEF DESCRIPTION OF THE DRAWINGS

FIG. 1 is a representation of the game board depicting the initial arrangement of the game pieces.

FIG. 2 show representations of the game board on which are illustrated the movement capabilities of the various pieces.

DESCRIPTION.

At the onset of the game, each set consists of 30 pieces, and both sets are arranged in the same way. The battlefield of 126 squares is used with its width facing the given player, so that where the end squares of the first row of 9 squares are black, there the black set shall be. All moves are confined to the battlefield.

The black capital always occupies the black capital square. The capital square is the central square on either extreme end of the battlefield in the end row of 9 squares across the width. Then, at the onset of the game, each set is arranged as follows: the two generals occupy adjacent squares on either side of the capital, in the same extreme end row; the eleven ambients occupy the 9 squares of the first row in front of the capital plus the two end squares of the second row in front of the capital; the seven patrols occupy the remaining 7 squares of said second row; the nine regulars occupy the 9 squares of the third row in front of the capital.

No square is ever occupied by two or more pieces at one time, and no piece can overstep or overjump another.

The generals, if unobstructed, can move up to 5 squares in any direction straight or diagonally from the square occupied; if unobstructed, they can also move in any complete 90 degree angle diagonally to end on the 4th square in a straight line from the square occupied (the major angle), or they can move in any complete 90 degree angle straight to end on the 2nd square in a diagonal line from the square occupied (the minor angle). The generals, if unobstructed, can capture any opposing piece up to 2 squares in any direction straight or diagonally from the square each of them occupies, but they cannot capture by the minor angle.

The ambients, if unobstructed, can move up to 2 squares in any direction straight or diagonally from the square each of them occupies. They can capture any opposing piece on any square adjacent to the square occupied. The ambients can also form a group of four of the same set standing on 4 adjacent squares arranged altogether like a square, which group of four (the tetrad), if unobstructed and if no fifth ambient of the same set occupies any adjacent square, can move together as one unit the distance of one square in any direction. However, each member of an ambient tetrad captures and gets captured individually. Ambients are the only type of pieces which can move in tetrads.

An ambient tetrad need not be isolated from generals, regulars, patrols of the same set or any piece of the opposite set. An ambient tetrad must be isolated only from ambients of its own set, in order to move as a tetrad.

The regulars, if unobstructed, can move up to 2 squares in any direction straight from the square each of them occupies and can capture any opposing piece on any square straight-adjacent from the occupied square.

The patrols, if unobstructed, can move up to 2 squares in any direction diagonally from the occupied square and can capture any opposing piece on any square diagonally adjacent to the occupied square.

Capture is limited to opposing pieces only and is optional.

The black always moves first.

A move ends when a piece changes the square it occupies once, or captures an opposing piece once. An allowable move is not retracted.

The capital cannot move, cannot capture and cannot be recaptured.

If unobstructed a moveable piece can always move a lesser distance than the maximum allowed and can always capture at a lesser distance than the maximum allowed if that is possible.

More than one piece per move cannot be captured, and the capturing piece must occupy the square of the captured piece.

A patrol moving on squares the same color as the square occupied by the opposing capital can capture said capital, and such a patrol is termed a primary or superior patrol; a patrol moving on squares of a different color cannot capture said capital and is termed a secondary or inferior patrol.

A game ends when an actual (where the capital square is occupied) or assumed (where one player loses all of this moveable pieces before an actual capture can occur) or compulsory (by sequence of moves) capture of one of the capitals occurs, or when a draw is called, or when one player surrenders.

If one of the players loses all the moveable pieces of his set still before an actual capture of his capital occurs, yet his opponent has a piece that could carry out an actual capture, then this situation describes an assumed capture; if the opponent has no piece that could carry out an actual capture, then there is a draw.

If in the sequence of alternate moves a player is forced to make a move that would expose his capital to actual capture, no alternative move possible, then this situation describes a compulsory capture of said capital.

There is no difference as to value among the actual, assumed and compulsory captures of a given capital. The game is won by whichever player achieves any such capture of the opponent's capital. A draw exists when no player is capable of winning the game.

I claim:

1. A method of playing a game comprising the steps of:

providing a rectangular game board of 126 checkered squares, 14 squares in length and 9 squares in width; providing each player with a set of 30 black pieces or 30 white pieces, each of the two sets consisting of different pieces including one capital piece, two general pieces, eleven ambient pieces, seven patrol pieces, and nine regular pieces;

positioning said game board such that the width of the board faces each player;

positioning the pieces at the outset of the game by placing the capital piece on the central square of the end row of 9 squares, placing the two general pieces on the two squares adjacent to the capital in the same row of 9 squares, placing nine ambient pieces on the 9 squares of the first row in front of the capital, placing the remaining two ambient pieces on the 2 end squares of the second row in front of the capital, placing the seven patrol pieces on the remaining squares of the second row of 9 squares in front of the capital, and placing the nine regular pieces on the third row of 9 squares in front of the capital;

designating a different movement capability to each of said different pieces;

each player taking turns moving said pieces in single moves; optionally capturing opposing pieces by moving a piece to a square occupied by an opposing piece;

winning the game by capturing the opposing capital, or else ending the game in a draw, a surrender, or a forfeiture.

2. The method of playing a game as recited in claim 1 further comprising the steps of:

allowing said two general pieces, if unobstructed to move up to 5 squares in any direction straight or diagonally from the occupied square, allowing said general pieces if unobstructed to move in any complete 90 degree major angle diagonally to the end on the 4th square in a straight line from the occupied square, allowing said general pieces, if unobstructed to move in any complete 90 degree minor angle straight to end on the 2nd square in a diagonal line from the occupied square, and allowing said general pieces, if unobstructed to capture any opposing piece up to 2 squares in any direction straight or diagonally from an occupied square but they cannot capture by the minor angle;

allowing said ambient pieces, if unobstructed to move up to 2 squares in any direction straight or diagonally from the occupied square, allowing said ambient pieces to capture any opposing piece on any square adjacent o the occupied square, allowing said ambient pieces to form a group of four ambients of the same set occupying 4 adjacent squares arranged altogether like a square, allowing said group of four ambients, if unobstructed and no fifth ambient of the set occupies any adjacent square, to move together as a unit the distance of one square in any direction, allowing each member of said group to capture or get captured individually;

allowing said patrol pieces, if unobstructed to move up to 2 squares in any direction diagonally from the occupied square, allowing said patrol pieces to capture any opposing piece on any square diagonally adjacent to the occupied square;

allowing said regular pieces, if unobstructed to move up to 2 squares in any direction straight from the occupied square, allowing said regular pieces to capture any opposing piece on any square straight adjacent to the occupied square.

* * * * *

UNITED STATES PATENT AND TRADEMARK OFFICE

CERTIFICATE OF CORRECTION

PATENT NO. : 4,982,965

DATED : January 8, 1991

INVENTOR(S) : Wolodymyr Y. Dozorsky

It is certified that error appears in the above-identified patent and that said Letters Patent is hereby corrected as shown below:

column 1, line 16

"...capture i the course..." should be "...capture in the course..."

column 1, line 29

"...EAch piece..." should be "Each piece..."

column 4, line 12

"...diagonally to the end..." should be "...diagonally to end on the 4th square..."

column 4, line 26

"...adjacent o the occupied square..." should be "...adjacent to the occupied square..."

Signed and Sealed this

Fourth Day of August, 1992

*Attest:*

*Attesting Officer*

DOUGLAS B. COMER

*Acting Commissioner of Patents and Trademarks*